US009327813B2

(12) United States Patent
Dogliotti

(10) Patent No.: US 9,327,813 B2
(45) Date of Patent: May 3, 2016

(54) BOAT SAIL COMPRISING SHAPE MEMORY MATERIAL ELEMENTS, APPARATUS AND METHOD FOR ITS OPERATION

(71) Applicant: Andrea Dogliotti, Genoa (IT)

(72) Inventor: Andrea Dogliotti, Genoa (IT)

( * ) Notice: Subject to any disclaimer, the term of this patent is extended or adjusted under 35 U.S.C. 154(b) by 0 days.

(21) Appl. No.: 14/765,232

(22) PCT Filed: Feb. 13, 2014

(86) PCT No.: PCT/IB2014/058972
§ 371 (c)(1),
(2) Date: Jul. 31, 2015

(87) PCT Pub. No.: WO2014/128599
PCT Pub. Date: Aug. 28, 2014

(65) Prior Publication Data

US 2015/0367923 A1 Dec. 24, 2015

(30) Foreign Application Priority Data

Feb. 19, 2013 (IT) ..... GE2013A0021

(51) Int. Cl.
*B63H 9/06* (2006.01)
*B63H 9/08* (2006.01)

(52) U.S. Cl.
CPC ..... *B63H 9/0657* (2013.01); *B63H 2009/0678* (2013.01); *B63H 2009/082* (2013.01); *B63H 2009/088* (2013.01)

(58) Field of Classification Search
CPC .. B63H 9/06; B63H 9/0657; B63H 2009/088; B63H 9/04; B63H 9/10; B63B 35/79
USPC ..... 114/39.11, 39.29, 97, 98, 102.22, 114/102.26
See application file for complete search history.

(56) References Cited

U.S. PATENT DOCUMENTS

| | | | |
|---|---|---|---|
| 4,337,090 | A | 6/1982 | Harrison |
| 4,830,262 | A | 5/1989 | Ishibe |
| 8,152,941 | B2 | 4/2012 | Sczerzenie et al. |
| 8,430,981 | B1 | 4/2013 | Sczerzenie et al. |
| 2007/0138341 | A1 | 6/2007 | Joshi et al. |
| 2011/0168072 | A1 | 7/2011 | Cross |

OTHER PUBLICATIONS

Voorhees, A., "Shape memory alloys could transform yachting", SMST E-Elastic newsletter, Jul. 2010, pp. 1-3.
EPO Decision to Grant European patent issued on May 20, 2015 for application No. EP 14 707 247.4-1751 filed on Feb. 13, 2014 in the name of Andrea Dogliotti.
PCT International Search Report mailed on May 13, 2014 for PCT/IB2014/058972 filed on Feb. 13, 2014 in the name of Andrea Dogliotti.
PCT Written Opinion mailed on May 13, 2014 for PCT/IB2014/058972 filed on Feb. 13, 2014 in the name of Andrea Dogliotti.
Communication under Rule 71(3) mailed on May 20, 2015 for EP Application No. 14707247 filed on Feb. 13, 2014 in the name of Andrea Dogliotti.

*Primary Examiner* — Lars A Olson
(74) *Attorney, Agent, or Firm* — Steinfl & Bruno LLP

(57) ABSTRACT

A sail for sailboats is described. The sail having portions wherein shape memory elements in the form of filiform members made of a shape memory alloy are incorporated, the surface area resulting from the sum of the surface areas of the portions incorporating shape memory alloy elements being between 0.01% and 50% of the surface area of the whole sail. A control apparatus is also disclosed for controlling the operation of the sail. A method is further disclosed for controlling operation of a sailboat sail.

23 Claims, 5 Drawing Sheets

BOAT SAIL COMPRISING SHAPE MEMORY MATERIAL ELEMENTS, APPARATUS AND METHOD FOR ITS OPERATION

CROSS REFERENCE TO RELATED APPLICATIONS

The present application is the US national stage of International Patent Application PCT/IB2014/058972 filed on Feb. 13, 2014 which, in turn, claims priority to Italian Patent Application GE2013A000021 filed on Feb. 19, 2013.

The present invention generally relates to sailboat wind propulsion and more particularly to sails for sailboats comprising elements made of shape memory alloys.

It is known that sails do not lie flat in the plane on which height and width are measured, but generally protrude in a direction perpendicular to said plane defining a specific curvature or camber continuously varying along both height and width directions. The camber is the key factor for a good aerodynamic performance of a sail and derives from design considerations.

It is known that sails are generally designed to have an optimal camber distribution according to foreseen wind conditions. Sailboats are also generally provided with means for camber adjustment in order to maximize their performance during navigation.

Traditional methods for harnessing wind power for forward motion have involved the use of sails controlled and manipulated by many lines, such as halyards, sheets, outhauls, downhauls, cunningham, yang and the like, as well as structures such as masts, booms, sprits, poles and the like, to shape the sails into appropriate wing profiles.

These control means are now part of the modern sophisticated sailing technique. However, the control of sail camber is and remains mainly affected by the tridimensional shape a sail has with respect to its flat e.g. triangle shape projected on the plane on which height and width are measured.

Alternative sail adjustment methods have recently been suggested based on the idea of employing shape memory alloys. The article "Shape memory alloys could transform yachting" by Adam Voorhees, published on Jul. 1 2010 on SMST E-Elastic newsletter, pages 1-3 proposes to manufacture boat sails provided with a shape memory alloy skeleton allowing to transform them from static or passive to dynamic or active structures, so as to achieve optimum performances at each sailing angle, wind speed and, more generally, sea condition. However, no specific ways to implement this general idea are disclosed.

Starting from this general idea, an aim of the invention is to provide a boat sail exploiting the technology of shape memory alloys. It is also an aim of the invention to provide an apparatus and a method for controlling operation of such a boat sail.

According to the invention, the boat sail comprises one or more discrete "active" portions wherein shape memory elements are incorporated, the surface area resulting from the sum of the surface areas of said portions being comprised between 0.01% and 50% of the surface area of the whole boat sail. The inventors in fact have found that it is not necessary to provide the whole sail with a skeleton made up of shape memory elements to adjust its shape, being it sufficient and more effective to apply such elements at discrete portions of the sail. In most cases the presence of shape memory elements proximate to sail vertices, i.e. where a sail is usually restrained to its supporting structure, is even useless or disadvantageous, because of the stresses the shape memory elements would be subject to in correspondence to the vertices.

Moreover, shape memory elements arranged at the sail vertices should be necessarily oversized, thus making the whole sail heavier and resulting in higher power consumption.

According to an embodiment of the invention, the portions of the sail comprising shape memory elements include groups of filiform members made of a shape memory alloy that are arranged in patterns parallel to or crossing each other. The overall surface area of the portions comprising shape memory elements is comprised between 3% and 50%, and more preferably between 5% and 30%, of the surface area of the whole sail.

According to an alternative embodiment of the invention, the portions of the sail comprising shape memory elements include single filiform members made of a shape memory alloy and extending along the sail surface. In this case the overall surface area of the shape memory elements is comprised between 0.01% and 3%, and more preferably between 0.2% and 1.5%, of the surface area of the whole sail.

The shape memory elements may be embedded in the sail structure e.g. during manufacturing or simply applied to its external surface; they may be part of the sail material itself or incorporated therein by way of soldering, gluing, sewing, molding, lamination, printing, sandwiching between sail layers or combinations thereof. The application on the external surface of a sail is particularly suitable for retrofitting of existing sails.

The arrangement of the shape memory elements relative to the supporting structures of the sail may be suitably chosen to meet specific design needs. The filiform members may e.g. be arranged parallel or perpendicular to either the mast or the boom, or inclined relative thereto. The filiform members may also be arranged in groups parallel to each other or according to crossing patterns.

The filiform members may also be advantageously arranged according to the strain lines of the sail.

According to a further aspect of the invention, filiform members made of a shape memory alloy may also be used to make tightening ropes of a sail, which may be used alternatively to the ropes traditionally employed to restrain the sails to the mast, boom, forestay and more generally to any sail supporting structure provided on a boat.

The filiform members incorporated in the sail and are connected to and powered by way of a sail control apparatus that may also comprise tightening ropes made of a shape memory alloy. More particularly, the filiform members are connected to electric terminals restrained to the supporting structure of the sail. The electric terminals are in turn connected to an electric interface operably connected to an electrical power source. The electric interface may be configured to selectively supply the filiform members incorporated in the active portions of the sail, thereby allowing to thermally activate only some of them, as well as to finely control the sail shape, size and camber.

The power supply may advantageously be adjustable. To this aim the control apparatus may comprise manual drivers. Automatic or semi-automatic control of the power supply is also possible and to this aim the control apparatus may comprise a microprocessor storing a control program and possibly configured to receive external inputs from one or more sensors installed at predetermined positions of the active portions of the sail and/or on the sailboat where the sail is mounted. Further sensors may also be installed on other non-active portions of the sail or elsewhere on a sailboat wherein the sail is mounted in order to gather comparison and reference data.

Further advantages and features of the sail according to the present invention, as well as of its control apparatus and method, will become clear to those skilled in the art from the following detailed and non-limiting description of embodiments thereof with reference to the attached drawings, wherein:

FIG. 1 schematically shows a sail boat whose sails comprise portions wherein shape memory elements are incorporated;

Figure 1:
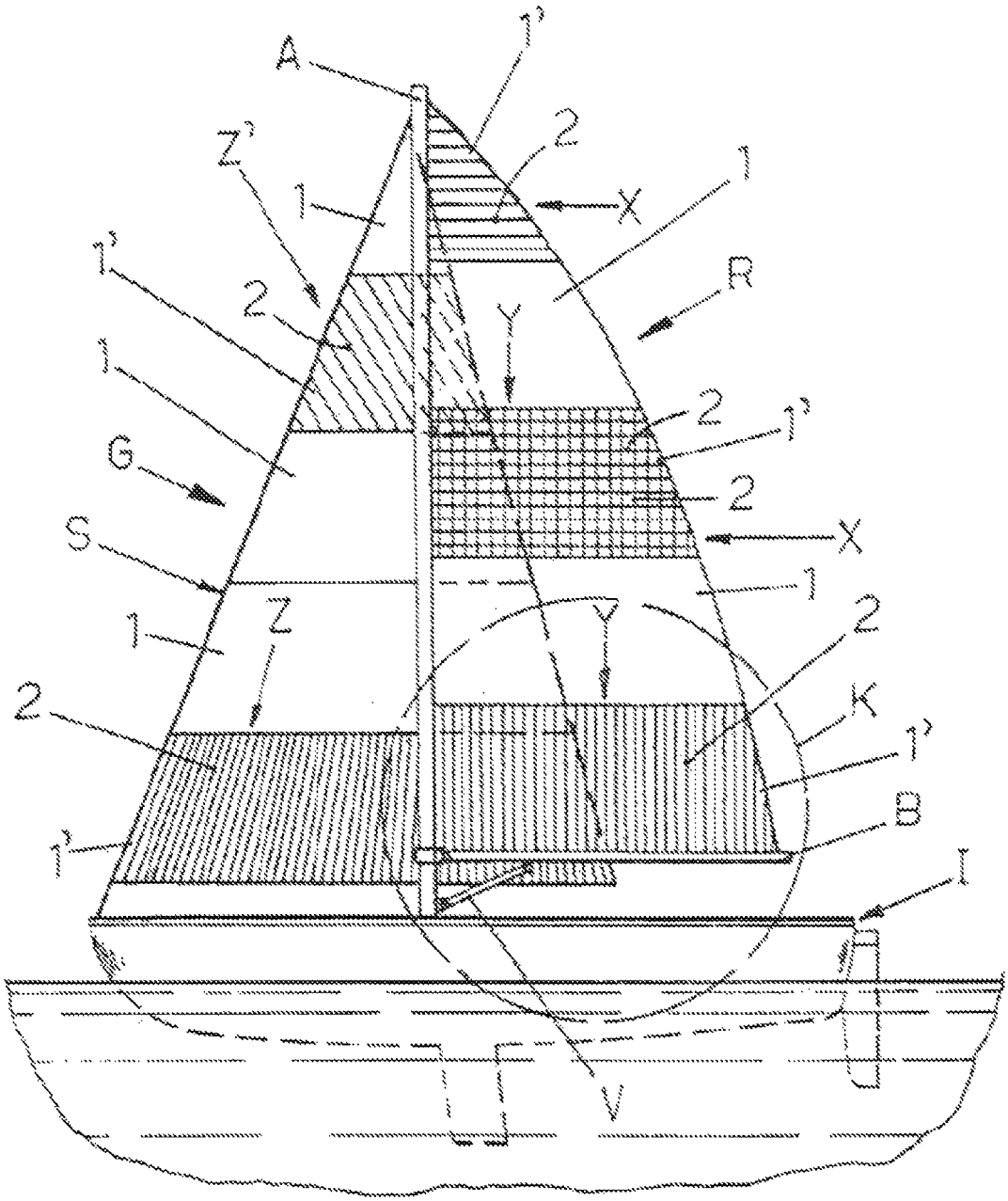

The dimensions and dimensional ratios of the elements shown in the drawings have been altered in order to facilitate their understanding. In particular, the thickness of the filiform members forming the shape memory elements has been enlarged to clearly show their arrangement relative to the sail and its supporting structure. Moreover, elements that are not essential for the understanding of the invention, such as electrical connections and electrical cables/wires, have not been depicted also owing to the great freedom in their nature and positioning.

Figure 3:
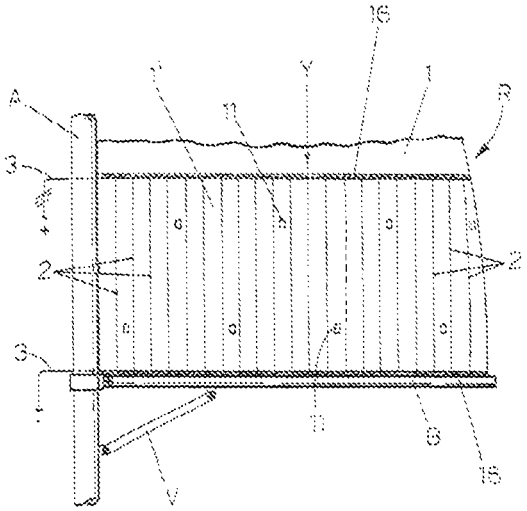
FIG. 3 is an enlarged view showing a detail K of FIG. 1.

With reference to FIGS. 1 and 3, A, B and V respectively indicate the main mast, the boom and the yang of a sail boat I e.g. having a traditional mainsail R and a genoa sail G.

However, the invention is not directed to any particular type of sail and may be advantageously applied to sails of small tonnage sailboats and luxury yachts. Hence, the sails of the invention may vary a lot in size and shape. Reference will be made in the following to Bermuda rigging sailboats such as the one exemplified in FIG. 1 and to the mainsail in particular, being it clear that any other sail or equipment may be improved according to the teachings of the present invention.

The shape of a sail is typically roughly triangular or trapezoidal. The sides of the sail that are not restrained to the main mast or to the boom, which is the case of a Bermuda mainsail, or to the forestay, which is the case of a Bermuda headsail, are generally straight or slightly arch-shaped. The sails generally feature a maximum height h, corresponding to the straight side connected to the main mast, and a maximum width w, corresponding to the straight side restrained to the boom.

Sailboats may employ one or more sails according to the present invention. Hence, height h and width w may vary a lot depending on the boat tonnage. For instance, the sail height may be comprised between 2 and 100 m, while the sail width may be comprised between 1 and 50 m.

According to the present invention and referring to FIGS. 1 and 3, a boat sail comprises portions 1 e.g. made of traditional sail cloths o other suitable materials generally employed in sail manufacturing, as well as portions 1' e.g. made of the same material wherein shape memory elements in the form of filiform members 2 such as e.g. wires, filaments or ribbons made of a shape memory alloy (SMA) are incorporated.

The ratio between the height and width of the filiform members 2 relative to their thickness is at least 3 and more preferably 5, which is the case of a ribbon or a thin sheet. Preferred is the use of filaments and wires, wherein the ratio between height with either width or thickness is preferably at least 5 and even more preferably higher than 100. The difference between a filament and a wire is that the width and thickness of the latter are comparable to each other and the cross section is generally circular or elliptical. For the purposes of the invention, preferred is the use of wires having a diameter comprised between 0.1 and 2 mm.

Incorporation of the shape memory elements in a sail may be made either during its manufacturing or afterwards as a retrofitting of an existing sail, and allows to adjust in a fine manner the tension and the shape of the sail.

It is known that when elements made of a shape memory alloy are thermally actuated they are shortened by a well predictable percentage which is up to about 8%-9% depending on the material and heat amount. Consequently, the size of the portion of the sail wherein the SMA elements are actuated is reduced, the effect being most prevailing on the sail camber. Upon interruption of thermal actuation the SMA elements are cooled and return to their initial size, thereby restoring the original sail size, shape and camber.

To this aim, a sail control apparatus allowing to manage operation of the portions of the sail incorporating the shape memory elements is also provided by the invention. The control apparatus will be described in greater detail in the following and comprises a power source and control electronics to which the shape memory elements are operably connected in an operating condition of the sail.

In the light of the above, it may be said that the portions of the sail incorporating the shape memory elements are "active" portions if compared to the portions not incorporating shape memory elements that may be seen as "passive" because their shape and size cannot be modified.

According to an embodiment of the invention, the filiform members 2 of each portion 1' may be grouped in patterns substantially parallel to each other e.g. in a vertical direction Y or in a horizontal direction X, as respectively shown in the upper and lower part of the mainsail R shown in FIG. 1. The average distance or tread between the parallel filiform members, wires in particular, is preferably comprised between 20 and 500 mm.

It will be understood that an arrangement of the filiform members perfectly parallel to each other is an ideal condition not practically achievable in a real sail. For the purposes of the present invention, the filiform members are considered parallel within a tolerance interval up to 30°.

The filiform members 2 may also be arranged according to a crossing pattern e.g. along the horizontal and vertical directions X, Y as shown in the intermediate portion of the mainsail R of FIG. 1. Inclined arrangements of parallel filiform members, as well as crossing patterns wherein the filiform members are inclined relative to the horizontal and vertical directions X, Y, as e.g. indicated with Z, Z' in the genoa sail of FIG. 1, are also encompassed by the present invention.

Figure 6:
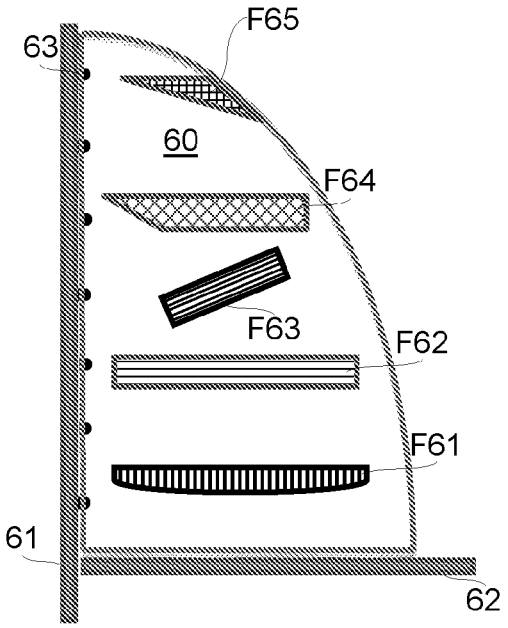
FIGS. 6 to 10 show further exemplary embodiments of sails according to the present invention.
Figure 7:
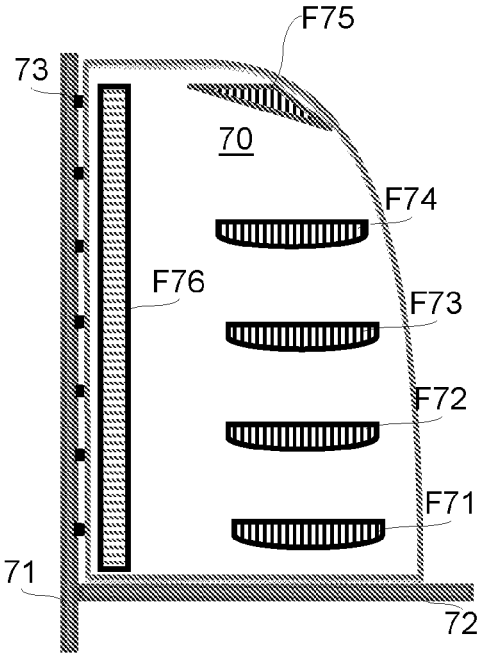
Figure 8:
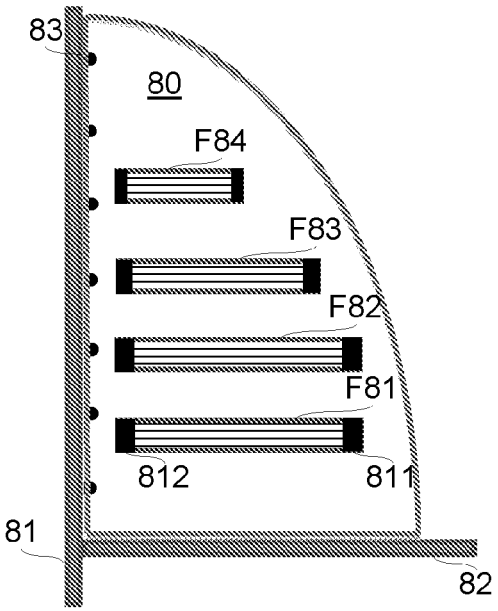

Further non-limiting examples of the arrangement of groups of filiform members relative to the supporting structure of a sail are shown in FIGS. 6 to 8, wherein the portions of the sails 60, 70, 80 comprising the filiform members are indicated by reference numerals F61 to F65, F71 to F76 and F81 to F84, respectively.

FIG. 7 e.g. shows a sail comprising a number of active portions among which a portion indicated by reference numeral F76 is arranged proximate to or along the edge of the sail intended to be connected to the mast of a sailboat. Portion F76 has a height comprised between 60% and 100% of the maximum height of the sail and a width comprised between 1% and 40%, preferably between 2% and 20%, of the maximum width of the sail.

The filiform members grouped in portion F76 are arranged perpendicular to the sail edge and hence to the mast of the sailboat once the sail is mounted thereon. This arrangement and configuration of the active portion F76 has the technical effect of providing an active portion at a location of the sail surface wherein camber design adjustments in a horizontal direction are most often necessary and effective.

In other words, portion F76 is one of the most important active portions of the sail. The further active portions shown in FIG. 7 may be optionally present and provide additional filiform members arranged parallel to the sail edge and hence to the mast of the sailboat, thus acting in the vertical direction.

The ends of the active portions comprising the filiform members may advantageously be free from shape memory elements and may thus be used as attachment means for fixing the active portions to a standard sail for retrofitting purposes. Such an embodiment of the invention is e.g. shown in FIG. 8, wherein the ends of the portions F81 to F84 of the sail 80 free from shape memory elements are indicated by reference numerals 811, 812. This configuration is advantageous because it allows to ease fixing of the portions comprising shape memory elements to a sail.

The shapes and positions of the active portions shown in the drawings, as well as the arrangement of the shape memory elements, are only non-limiting examples of how such portions and elements may be made and arranged.

Figure 9:
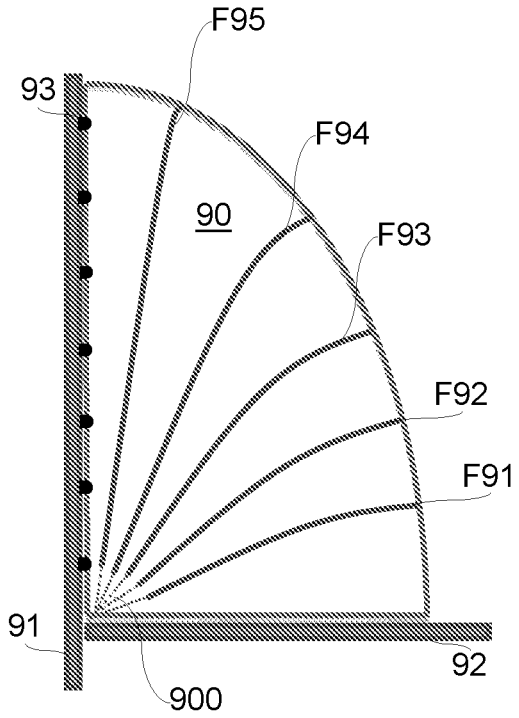
Figure 10:
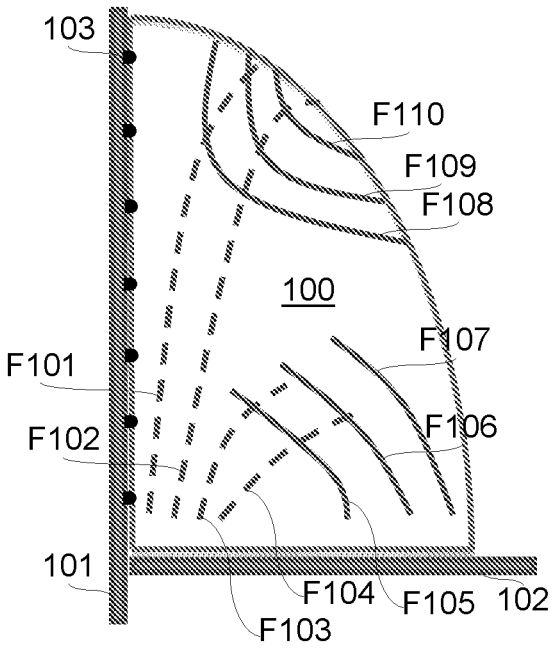

As shown in FIGS. 9 and 10, according to an alternative embodiment of the invention, the sail may include single filiform members made of a shape memory alloy extending across its surface on one or both faces of the sail. The portions of the sails 90, 100 comprising the filiform members are indicated by reference numerals F91 to F95 and F101 to F110, respectively.

More particularly, the sail 90 of FIG. 9 comprises single filiform members in the form of wires that e.g. converge towards the intersection between mast and boom 91, 92. As shown by way of dotted lines, the filiform members may be electrically connected to each other at a common point 900 so as to ease power supply. This configuration is useful when all the filiform members must be simultaneously activated, whereas a configuration wherein the filiform members are not electrically connected at a common point allows selective power supply thereof.

In the sail 100 shown in FIG. 10, the wires are arranged on both sides of the sail. As shown in the drawing, some of the wires arranged on one face, e.g. the wires shown by way of solid lines, cross the wires arranged on the opposite surface, e.g. the wires shown by way of dashed lines. If electrical contact, and thus mutual thermal activation, among crossing wires is not desired, it is possible to envision the presence of electrically insulating bridges/connections (not shown) or to exploit the sail material and thickness as an insulating member. This solution allows to selectively supply current to wires arranged according to crossing patterns.

Electric terminals 3 of the control apparatus allowing to supply current to the filiform members 2 may advantageously be arranged along reinforcing/connecting portions between adjacent sail cloths in the form of seams or rods 16. Anchors allowing to fix the filiform members to the sail body may also be advantageously arranged at the reinforcing portions 16. The electrical terminals 3 for powering the shape memory elements may also be arranged at and restrained to the mast, the boom, the stay or to any other supporting structure.

The surface area resulting from the sum of the surface areas of the portions of the sail comprising shape memory elements is comprised between 0.01% and 50% of the surface area of the whole sail. The inventor in fact has found that it is not necessary to provide the whole surface of a boat sail with a skeleton made up of shape memory elements to adjust its shape, being it sufficient and more effective to apply such elements at discrete portions of the sail.

In particular, the "active" portions of the sail, i.e. the portions incorporating shape memory elements, may have a smaller size relative to either or both the width and height of the sail portions where the shape memory elements are incorporated, provided that the overall surface area incorporating/containing the shape memory elements is lower than 50% of the whole surface area of the sail. According to a preferred embodiment of the invention, the widths of the active portions of the sail are comprised between 30% and 90% of the corresponding sail widths, whereby no modifications are required to connect the sail to the mast, boom, stay or any other sail supporting structure.

Similarly, the height of the active portions of the sail is comprised between 1 and 100% of the maximum height of the sail.

More particularly, in the case of groups of filiform members arranged parallel to each other or according to a crossing pattern, the overall surface area of the portions comprising shape memory elements is comprised between 3% and 50%, and more preferably between 5% and 30%, of the surface area of the sail.

In the case of single filiform members the surface area is comprised between 0.01% and 3%, and more preferably between 0.2% and 1.5%, of the whole surface area of the sail.

The shape memory elements may be embedded in the sail structure or simply applied to its external surface by way of soldering, gluing, sewing, molding, lamination, printing, sandwiching between sail layers or combinations thereof.

Among the class of shape memory materials suitable for the purposes of the present invention there are shape memory polymers and shape memory alloys. It is known that filiform components made of a shape memory alloy undergo shortening upon heating when their structure is subject to a phase change from martensitic (low temperature phase) to austenitic (high temperature phase).

Each alloy is typically characterized by four reference temperatures "As", "Af", "Ms", "Mf". "As" is the temperature at which the initial transition from Martensitic to Austenitic structure occurs due to heating, "Ms" is the temperature at which the reverse transition from Austenitic to Martensitic structure occurs when cooling starts. As in the case of the invention, cooling is often a passive cooling, resulting from the interruption of the heating step as a consequence of power supply interruption. "Af" and "Mf" are the temperatures at which complete phase changes occur. Shape memory alloys suitable for the purposes of the present invention preferably have an "Mf" temperature equal to or higher than 40° C. and an "As" temperature that is preferably about "10-20° C." higher than "Mf" temperature.

The other two reference temperatures characterizing the hysteresis cycle of a shape memory alloy play a marginal role for the purposes of the present invention.

A person skilled in the art does not need to be an expert in the field of shape memory materials, because there are many manufacturers that sell and supply shape memory alloys trained to specific transition temperatures and such alloys and their properties are known for a long time. More information on Ni—Ti based alloys may be retrieved from a vast variety of sources, for example patents U.S. Pat. Nos. 8,152,941 and 8,430,981 in the name of SAES Smart Materials about the latest developments on Nitinol, patent U.S. Pat. No. 4,830,262 in the name of Nippon Seisen about the basic Nitinol properties. Nitinol is the most diffused and common type of Ni—Ti based shape memory alloys.

Another family of shape memory alloys suitable for the purposes of the invention are based on Ni—Ti—Cu. More information about these alloys may be found in patent U.S. Pat. No. 4,337,090 to Raychem.

All these alloys feature a good ductility, superelastic features and an optimal corrosion resistance. Moreover, these alloys are not magnetic and have the ability to recover deformations up to about 8.5%.

Shape memory alloys featuring electrical resistivity and transition temperatures particularly suitable to be heated due to Joule effect by employing low power sources will preferably be chosen, because low power sources are typically adapted to be installed on a sailboat.

Figure 4:
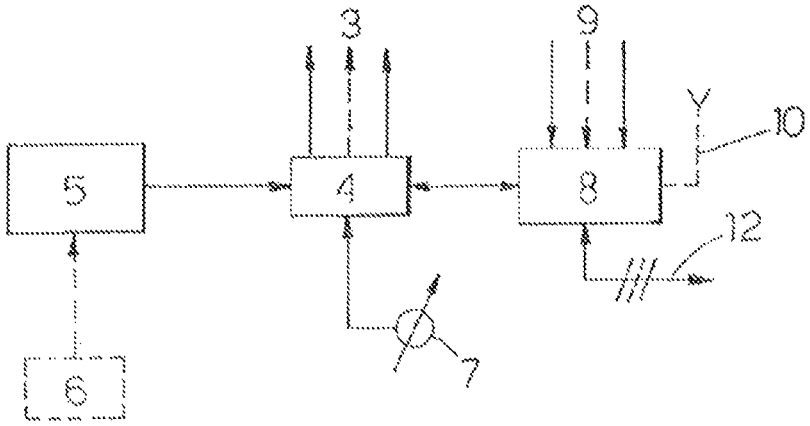
FIG. 4 is a block diagram schematically showing a control circuit of the sail control apparatus according to the present invention.

Now referring to FIG. 4 the apparatus method for controlling operation of the boat sails according to the invention will be disclosed. As explained above, in order to thermally activate the filiform members 2 incorporated in the sail, e.g. sail R and/or G, an electric current must be supplied. To this end, the control apparatus comprises electric terminals 3 to which the filiform members 2 are connected individually or in groups. The electric terminals 3 of the control apparatus may be advantageously restrained to the supporting structure of the sail, e.g. mast and/or boom. The electric terminals 3 are in turn connected to an electric interface 4 of the control apparatus, which is operably connected to an electrical power source 5 thereof, which may advantageously be an electric accumulator provided with optional recharging means 6, such as e.g. solar panels and/or wind power generators or other small electric generators typically employed on boats.

The electric interface 4 is configured to selectively or concurrently supply the filiform members 2 arranged in the active portions of the sails. Hence, it is possible to thermally activate only some of the active portions of the sail, so as to allow to finely control its shape and size, and consequently its camber.

The power supply is preferably adjustable e.g. by way of a manual driver 7 operably connected to the electric interface 4. Alternatively or additionally, power supply may be automatically or semi-automatically adjusted by way of a microprocessor 8 of the control apparatus provided with a suitable control program.

The control apparatus may advantageously comprise one or more sensors 11, like e.g. pressure, strain, distortion, wind speed and wind direction sensors installed at predetermined positions of the active portions 1' of the sail and/or on the sailboat where the sail is mounted. The sensors 11 are operably connected to the microprocessor 8 through a circuit 9 and/or from a wireless connection by way of an antenna 10 and provide the microprocessor with external inputs allowing to operate the filiform members 2 not only based on the control program stored in the microprocessor but also taking into account external and environmental conditions, thus improving control of the sail.

Further sensors may be installed on the passive portions 1 of the sail or elsewhere on a sailboat wherein the sail is mounted in order to gather comparison and reference data.

Other inputs to the microprocessor 8 could be provided through at least one supplementary input unit 12 operably connected thereto.

The use of an automatic control is particularly suitable for selective operation of the filiform members 2 either single or arranged in groups based on the inputs provided by the sensors. The current supplied to the active portions of the sail depends on the number, size and type of shape memory elements incorporated therein. In the preferred case of shape memory wires, a current comprised between 100 mA and 20 A is supplied to every one of them. Those skilled in the art will understand that the current values are related to the wires size. In view of this the ratio between current and diameter is comprised in the range is preferably comprised between 1000 and 10000 mA/mm.

Figure 2:
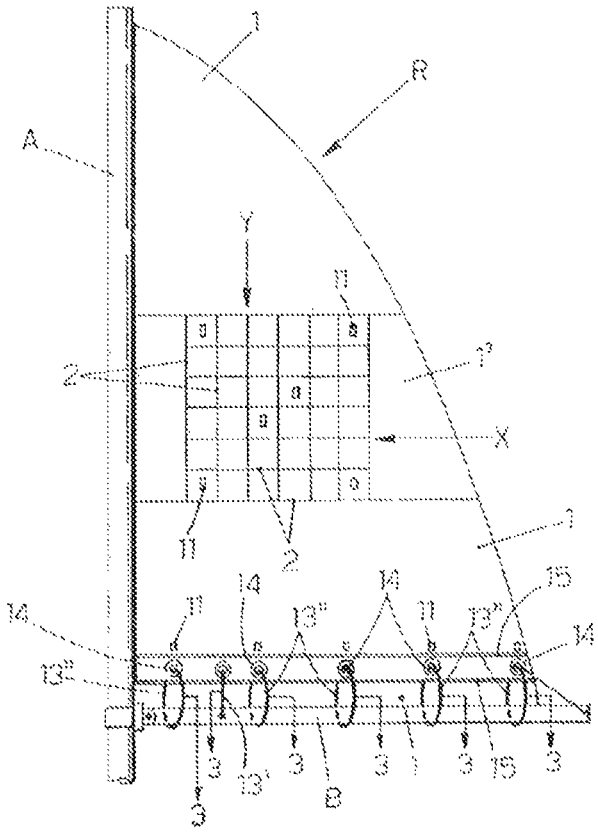
FIG. 2 is an enlarged view schematically showing a sail that may be used on the boat of FIG. 1.

Again with reference to FIG. 2 according to a further aspect of the invention the filiform members 2 made of a SMA alloy may also be used to make tightening ropes for adjustment of the sails of a sailboat. The ropes may be simple straight ropes, as indicated by reference numeral 13', or ropes configured as a loop, as indicated by reference numeral 13". The ropes may also be associated with kinematic chains, for example connecting the boom B to the mainsail R, the latter being suitably reinforced to allow to anchor a rope, for example provided with eyelets 14 and/or with seams or rods 15.

Figure 5:
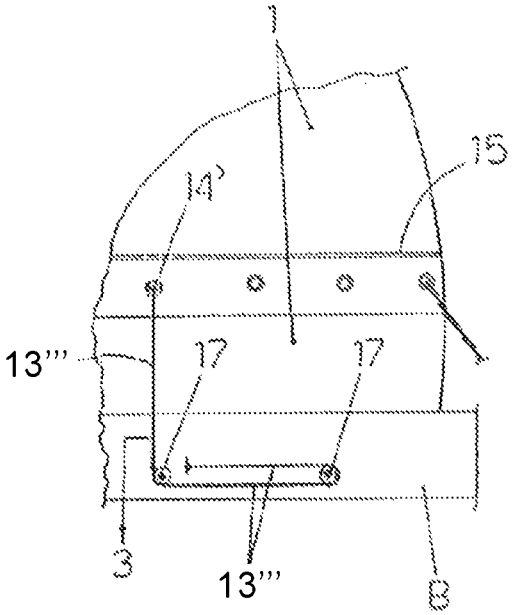
FIG. 5 shows a detail of a traction system for tightening the sails, the system comprising ropes made of or including shape memory elements.

With reference to FIG. 5, for example, a rope 13''' anchored at one end to the boom B is arranged so as to pass around a pair of pulleys 17 and anchored to an eyelet 14' formed on a portion 1 of e.g. the mainsail R. The arrangement of the rope 13''' and the pulleys 17 is such that the linear contraction of the rope 13''' is multiplied about three times with respect to the straight ropes 13' mentioned above, thus achieving a higher traction effect on the mainsail R.

The ropes 13', 13" and 13''' comprising filiform members made of a SMA alloy are a part of the control apparatus for controlling operation of the boat sails according to the invention and may advantageously be connected to the same control circuit described above with reference to FIG. 4, so as to improve adjusting of the sail during navigation by acting on traditional driving means. Those skilled in the art will understand that the ropes may be used in addition or alternatively to the shape memory elements incorporated in the sail. Moreover, the ropes might possibly be connected to a separate control circuit of the control apparatus analogous to the control circuit described above.

The provision of ropes made of SMA alloys is particularly important when large contractions of sail portions having a small surface area are desired. The strain and/or pressure sensors 11 installed on the sail may also be used to control operation of the ropes 13', 13", 13'''. Similar solutions may be foreseen to restrain the sails R and G to a mast A, as well as to a forestay S preferably when this is in the form of a metal profiled bar.

The present invention has hereto been disclosed with reference to preferred and non-limiting embodiments thereof. It will be understood that there may be other embodiments relating to the same inventive idea, as defined by the scope of protection of the claims set forth below.

The invention claimed is:

1. A sail for sailboats, said sail comprising portions wherein shape memory alloy elements are incorporated, the surface area resulting from the sum of the surface areas of said portions being comprised between 0.01% and 50% of the surface area of the whole sail, wherein the shape memory elements are filiform members, said filiform members being wires, filaments or ribbons and wherein the filiform members are grouped in patterns parallel to each other or according to a crossing pattern.

2. The sail according to claim 1, wherein the filiform members are wise having a wire diameter comprised between 0.1 and 2 mm.

3. The sail according to claim 1, wherein the average distance between the parallel filiform members is comprised between 20 and 500 mm.

4. The sail according to claims 1, wherein a portions of the sail incorporating the shape memory alloy elements has a height comprised between 60% and 100% of the maximum height of the sail and width comprised between comprised between 1% and 40% of the maximum width of the sail.

5. The sail according to claim 4, wherein the portion of the sail incorporating the shape memory alloy elements is arranged proximate to or along the edge of the sail intended to be connected to the mast of a sailboat and wherein the shape memory alloy elements are filiform members arranged perpendicular to said edge.

6. The sail according to claim 1, wherein the shape memory alloy elements are embedded in the sail structure or applied to its external surface by way of soldering, gluing, sewing, molding, lamination, printing, sandwiching between sail layers or combinations thereof.

7. The sail according to claim 1, wherein said shape memory alloy has an austenitic phase start temperature that is 10° C. to 20° C. higher that its martensitic phase completion temperature.

8. The said according to claim 7, wherein said shape memory alloy has a martensitic phase completion temperature equal to or higher than 40°C.

9. The sail according to claim 1, wherein said shape memory alloy is a Ni—Ti alloy or a Ni—Ti—Cu alloy.

10. A system comprising a sail according to claim 1 and a control apparatus, said apparatus comprising electric terminals configured to be connected to filiform members made of a shape memory alloy incorporated in portions of said sail, the control apparatus further comprising an electric interface and an electric power source operably connected to said electric interface, wherein the electric interface is configured to supply, either concurrently or selectively, electric current to the filiform members in an operating condition of the control apparatus.

11. The system according to claim 10, further comprising current adjusting means, said means comprising a manual driver operably connected to the electric interface and/or a microprocessor operably connected to the electric interface and provided with a control program.

12. The system according to claim 10, further comprising one or more sensors configured to be installed at predetermined positions of the sail, said sensors being operably connected to the microprocessor through a circuit and/or a wireless connection by way of an antenna.

13. The system according to claim 12, wherein said sensors comprise pressure, strain, distortion, wind speed and wind direction sensors.

14. The system according to claim 10, further comprising sail tightening ropes, said ropes being made of or incorporating filiform members made of a shape memory alloy, whereby the ropes are connected to the power source allowing to supply the filiform members through the same electric interface, said interface being configured to supply the filiform members and the ropes selectively or concurrently.

15. A method for controlling operation of a sailboat sail, said method comprising the steps of:

i) providing a sail according to claim 1;

ii) arranging the portions comprising the patterns of shape memory alloy elements relative to the height and which directions of the sail; and iii) selectively supplying an electric current to one or more of said shape memory alloy elements.

16. The control method according to claim 15, wherein the shape memory alloy elements are wires and wherein the ratio between current and wire diameter is comprised between 1000 and 10000 mA/mm.

17. The control method according to claim 15, wherein current supply is manually, automatically and/or semi-automatically controlled.

18. The control method according to claim 17, wherein current supply is automatically controlled based on a control program stored in a microprocessor of a control apparatus and on external inputs provided by a number of sensors installed on the sail or on a sailboat where the sail is mounted.

19. The control method according to claim 18, wherein said external inputs comprise pressure, stain, distortion of the sail and wind speed and direction.

20. The control method according to claim 15, further comprising a step of providing the sail with tightening ropes made of or incorporating filiform members made of a shape memory alloy and a step of selectively supplying an electric current to one or more of said ropes.

21. The sail according to claim 1, wherein the surface area resulting from the sum of the surface areas of said portions is comprised between 3% and 50% of the surface area of the whole sail.

22. The sail according to claim 21, wherein the surface area resulting from the sum of the surface areas of said portions is comprised between 5% and 30% of the surface area of the whole sail.

23. The said according to claim 4, said width being comprised between 2% and 20% of the maximum width of the sail.

* * * * *